US010020601B1

(12) United States Patent
Hsu

(10) Patent No.: US 10,020,601 B1
(45) Date of Patent: Jul. 10, 2018

(54) CABLE CONNECTION DEVICE

(71) Applicant: Dong Guan Bright Yinhuey Lighting Co., Ltd. China, Guang Dong (CN)

(72) Inventor: Kevin Hsu, Taichung (TW)

(73) Assignee: Dong Guang Bright Yinhuey Lighting Co., Ltd. China, Guang Dong (CN)

( * ) Notice: Subject to any disclaimer, the term of this patent is extended or adjusted under 35 U.S.C. 154(b) by 0 days.

(21) Appl. No.: 15/709,521

(22) Filed: Sep. 20, 2017

(51) Int. Cl.
*H01R 4/24* (2018.01)
*H01R 9/03* (2006.01)
*H01R 4/2404* (2018.01)
*H01R 4/2433* (2018.01)

(52) U.S. Cl.
CPC ..... *H01R 9/031* (2013.01); *H01R 4/2404* (2013.01); *H01R 4/2433* (2013.01)

(58) Field of Classification Search
CPC ..... H01R 4/2433
USPC ..... 439/402, 409, 411, 417
See application file for complete search history.

(56) References Cited

U.S. PATENT DOCUMENTS 3,804,971 A * 4/1974 Bazille, Jr. ..... H01R 4/2433 174/88 R
4,533,199 A * 8/1985 Feldberg ..... H01R 4/2433 29/838
5,019,795 A * 5/1991 Patel ..... H01H 36/0033 335/205
5,735,706 A * 4/1998 Ito ..... H01R 4/2433 439/402
6,443,755 B1 * 9/2002 Beukes ..... H01R 4/2433 439/402
7,530,827 B2 * 5/2009 Caveney ..... H01R 4/2433 439/211
7,867,013 B2 * 1/2011 Cox ..... H01R 4/2433 439/404
8,246,361 B2 * 8/2012 Dennes ..... H01R 4/2433 439/107
9,577,353 B2 * 2/2017 Shi ..... H01R 4/2433

* cited by examiner

*Primary Examiner* — Tho D Ta
(74) *Attorney, Agent, or Firm* — Alan D. Kamrath; Kamrath IP Lawfirm, P.A.

(57) ABSTRACT

A cable connection device includes a first shell, a plurality of conducting terminals mounted on the first shell, and a second shell covering the first shell. The first shell includes a main portion provided with a receiving recess and a restriction portion provided with a plurality of mounting spaces. The conducting terminals extend into the mounting spaces respectively. The second shell is provided with a plurality of press blocks. When the conducting wires of each of the two cables extend to the conducting terminals, the press blocks extend into the mounting spaces and press the conducting wires of each of the two cables, with the conducting terminals piercing the conducting wires of the two cables simultaneously, to connect and electrically conduct the conducting wires of the two cables by the conducting terminals.

9 Claims, 4 Drawing Sheets

CABLE CONNECTION DEVICE

BACKGROUND OF THE INVENTION

1. Field of the Invention

The present invention relates to a connection device and, more particularly, to a cable connection device.

2. Description of the Related Art

In general, the chandelier is mounted at a higher position. A cable has a determined length so that it is necessary to connect and electrically conduct two cables for mounting the chandelier. However, the operator has to connect the two cables at the higher position, so that the operator cannot connect the two cables by hot melt welding, and has to connect the two cables by a manual labor, thereby decreasing the efficiency of assembly, and thereby decreasing the strength of connection of the two cables. In addition, when the two cables are connected, an insulating tape is wound around the connecting position of the two cables, thereby decreasing the aesthetic quality.

BRIEF SUMMARY OF THE INVENTION

In accordance with the present invention, there is provided a cable connection device comprising a first shell, a plurality of conducting terminals mounted on the first shell, a second shell covering the first shell, and two cables mounted on the first shell and the second shell. The first shell includes a main portion and a restriction portion mounted on the main portion. The main portion is provided with a mounting face which is provided with a receiving recess. The restriction portion is secured in the receiving recess and is provided with a plurality of partitions and a plurality of mounting spaces located between the partitions. The conducting terminals extend into the mounting spaces respectively. The second shell is provided with a plurality of press blocks. Each of the two cables includes a plurality of conducting wires. Each of the conducting wires includes a conducting core and an insulating layer coating an outside of the conducting core. The conducting wires of each of the two cables extend to the conducting terminals, and the press blocks of the second shell extend into the mounting spaces and press the conducting wires of each of the two cables, with the conducting terminals piercing the conducting wires of the two cables simultaneously, to connect and electrically conduct the conducting wires of the two cables by the conducting terminals.

According to the primary advantage of the present invention, the first shell is provided with the mounting spaces, the mounting spaces are provided with the conducting terminals, the second shell is provided with the press blocks, and the press blocks press the conducting wires of each of the two cables, so that the projections of the conducting terminals pierce the conducting wires of the two cables simultaneously, so as to connect and electrically conduct the conducting wires of the two cables by the conducting terminals.

According to another advantage of the present invention, the two cables are connected and conducted easily and quickly, thereby increasing the efficiency of assembly, and thereby enhancing the strength of connection of the two cables.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
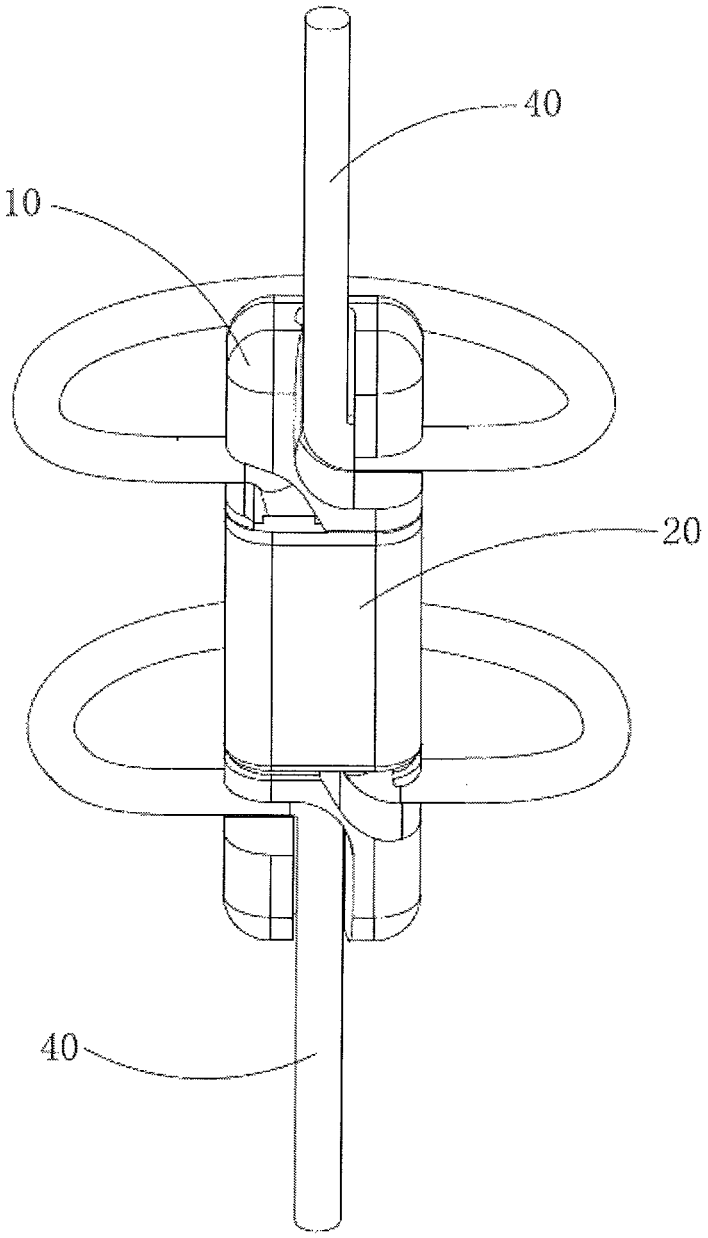
FIG. 1 is a perspective view of a cable connection device in accordance with the preferred embodiment of the present invention.
Figure 2:
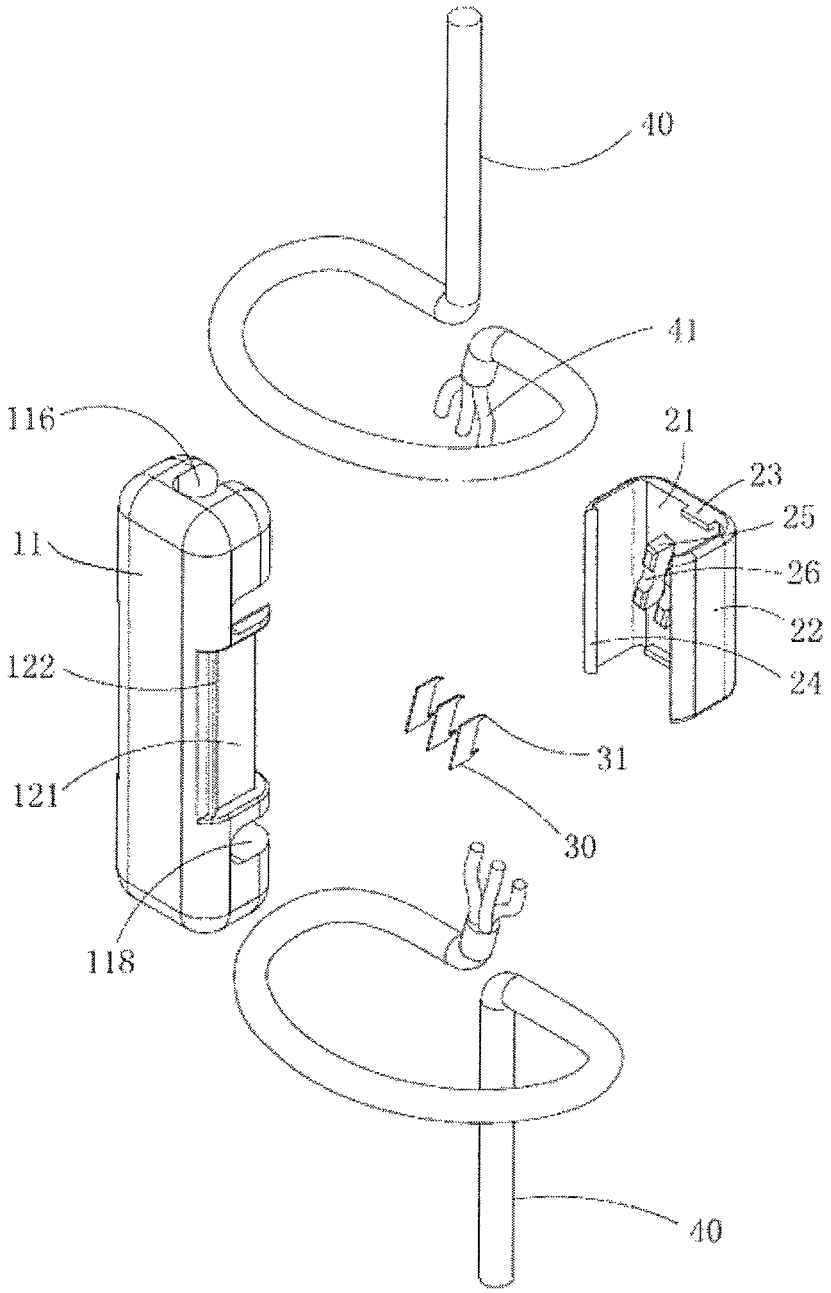
FIG. 2 is an exploded perspective view of the cable connection device in accordance with the preferred embodiment of the present invention.
Figure 3:
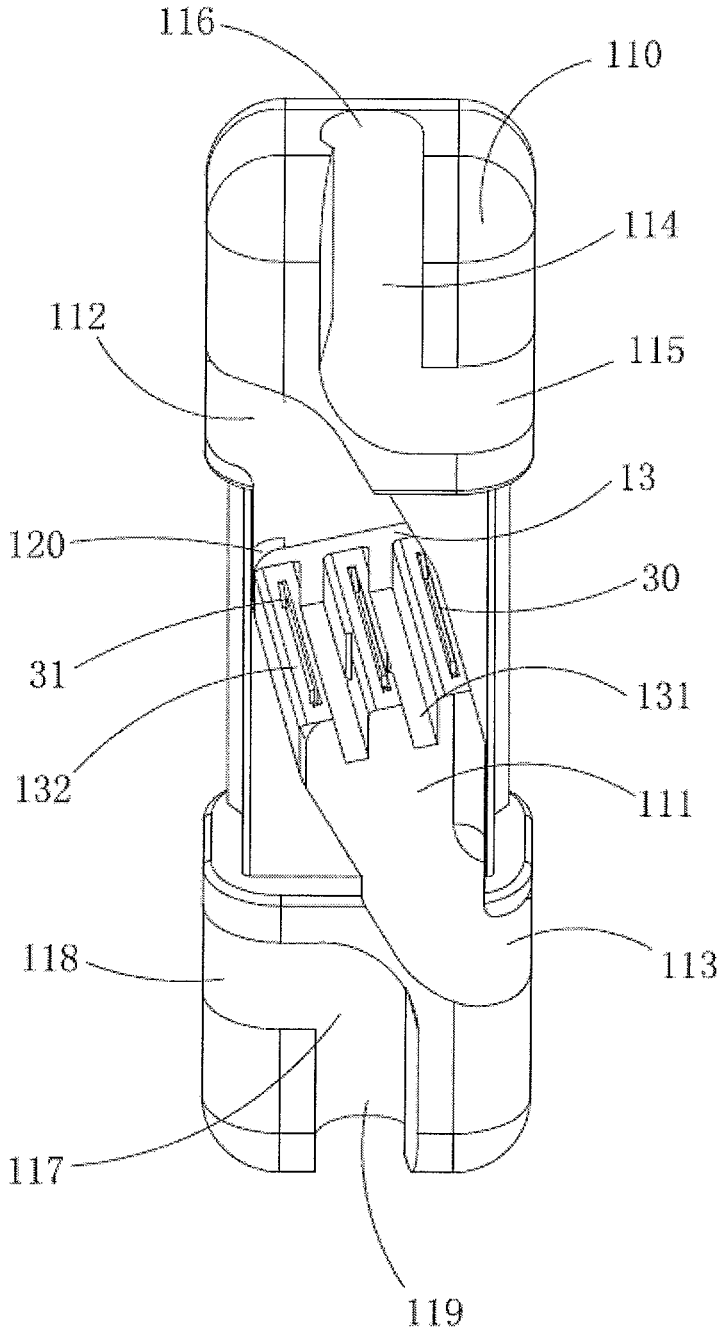
FIG. 3 is a partially perspective view of the cable connection device in accordance with the preferred embodiment of the present invention.
Figure 4:
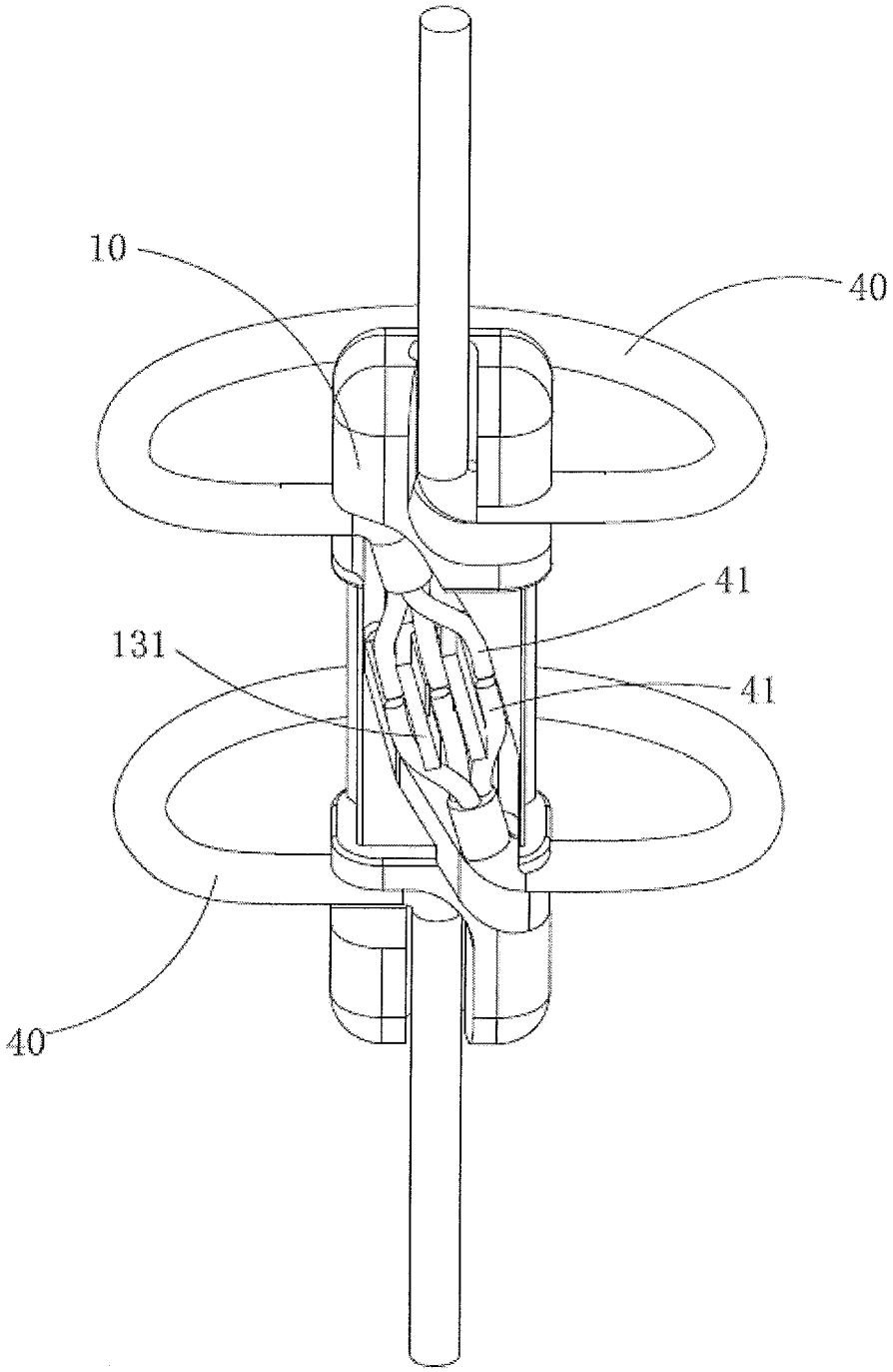
FIG. 4 is another partially perspective view of the cable connection device in accordance with the preferred embodiment of the present invention.

Referring to the drawings and initially to FIGS. 1-4, a cable connection device in accordance with the preferred embodiment of the present invention comprises a first shell 10, a plurality of conducting terminals 30 mounted on the first shell 10, a second shell 20 combined with and covering the first shell 10, and two cables 40 mounted on the first shell 10 and the second shell 20. The cable connection device is used to connect and electrically conduct the two cables 40. The first shell 10 and the second shell 20 construct a closed chamber into which the two cables 40 extend respectively.

The first shell 10 includes a main portion 11 and a restriction portion 13 mounted on the main portion 11. The main portion 11 is provided with a mounting face 110 which is provided with a receiving recess 111. The restriction portion 13 is secured in the receiving recess 111 and is provided with a plurality of partitions 131 and a plurality of mounting spaces 132 located between the partitions 131. The partitions 131 are parallel with each other and have an extending direction the same as that of the receiving recess 111. The conducting terminals 30 extend into the mounting spaces 132 respectively. The second shell 20 is provided with a plurality of press blocks 25. Each of the two cables 40 includes a plurality of conducting wires 41. Each of the conducting wires 41 includes a conducting core and an insulating layer coating an outside of the conducting core.

In assembly, the conducting wires 41 of each of the two cables 40 extend to the conducting terminals 30, and the press blocks 25 of the second shell 20 extend into the mounting spaces 132 and press the conducting wires 41 of each of the two cables 40, so that the conducting terminals 30 pierce the conducting wires 41 of the two cables 40 simultaneously, to connect and electrically conduct the conducting wires 41 of the two cables 40 by the conducting terminals 30.

In the preferred embodiment of the present invention, the main portion 11 of the first shell 10 has two opposite sides each provided with a groove 121. The second shell 20 is substantially U-shaped and includes a cover plate 21 and two locking plates 22 extending from two opposite sides of the cover plate 21. Each of the two locking plates 22 extends into the respective groove 121. The press blocks 25 are located at an inner face of the cover plate 21.

In the preferred embodiment of the present invention, the groove 121 has a bottom wall provided with a rib 122, and each of the two locking plates 22 has a distal end provided with a hook 24 hooked onto the rib 122.

In the preferred embodiment of the present invention, each of the press blocks 25 has a middle position provided with a breach 26.

In the preferred embodiment of the present invention, the receiving recess 111 is arranged in an inclined manner, with an angle being defined between an extending direction of the receiving recess 111 and that of the main portion 11. Each of the press blocks 25 is arranged in an inclined manner and has an inclination equal to that of the partitions 131. The press blocks 25 are parallel with each other.

In the preferred embodiment of the present invention, the cover plate 21 is provided with two opposite protruding pieces 23 extending into the receiving recess 111 and pressing the two cables 40.

In the preferred embodiment of the present invention, the receiving recess 111 has two sides extending toward the main portion 11 and forming a first opening 112 and a second opening 113.

In the preferred embodiment of the present invention, the mounting face 110 is further provided with a first channel 114 and a second channel 117, with the receiving recess 111 being arranged between the first channel 114 and the second channel 117. The first channel 114 and the second channel 117 are directed toward two opposite directions. Each of the first channel 114 and the second channel 117 has an extending direction intersecting that of the receiving recess 111. The first channel 114 has a substantially L-shaped arrangement and is formed with a first entrance 115 and a second entrance 116. The first entrance 115 and the first opening 112 are directed toward two opposite directions. The second channel 117 has a substantially L-shaped arrangement and is formed with a third entrance 118 and a fourth entrance 119. The third entrance 118 and the second opening 113 are directed toward two opposite directions.

In the preferred embodiment of the present invention, the receiving recess 111 has a bottom provided with a locking slot 120, and the restriction portion 13 is locked in the locking slot 120. Alternatively, the receiving recess 111 is integrally formed with the restriction portion 13.

In the preferred embodiment of the present invention, each of the conducting terminals 30 is a sheet plate and includes an embedding portion embedded into a bottom of the restriction portion 13 and two projections 31 protruding from the embedding portion and extending into each of the mounting spaces 132. Each of the two projections 31 is a sharp metallic piece.

In use, one of the two cables 40 extends through the first entrance 115 and the second entrance 116 into the first channel 114, then extends from the first entrance 115 to the back of the main portion 11, and then extends through the first opening 112 into the receiving recess 111, with the conducting wires 41 respectively extending into the mounting spaces 132. Similarly, the other one of the two cables 40 extends through the third entrance 118 and the fourth entrance 119 into the second channel 117, then extends from the third entrance 118 to the back of the main portion 11, and then extends through the second opening 113 into the receiving recess 111, with the conducting wires 41 respectively extending into the mounting spaces 132. At this time, the conducting wires 41 of each of the two cables 40 are located above the two projections 31 of each of the conducting terminals 30. When the second shell 20 is mounted on the first shell 10, each of the two locking plates 22 of the second shell 20 extends into the respective groove 121 of the first shell 10, the hook 24 of the second shell 20 is hooked onto the respective rib 122 of the first shell 10, and the two protruding pieces 23 of the second shell 20 press the two cables 40. At the same time, the press blocks 25 of the second shell 20 extend into the mounting spaces 132 and press the conducting wires 41 of each of the two cables 40, so that the projections 31 of the conducting terminals 30 pierce and electrically conduct the conducting wires 41 of the two cables 40. In such a manner, the conducting wires 41 of the two cables 40 are connected and conducted by the conducting terminals 30.

Accordingly, the first shell 10 is provided with the mounting spaces 132, the mounting spaces 132 are provided with the conducting terminals 30, the second shell 20 is provided with the press blocks 25, and the press blocks 25 press the conducting wires 41 of each of the two cables 40, so that the projections 31 of the conducting terminals 30 pierce the conducting wires 41 of the two cables 40 simultaneously, so as to connect and electrically conduct the conducting wires 41 of the two cables 40 by the conducting terminals 30. In addition, the two cables 40 are connected and conducted easily and quickly, thereby increasing the efficiency of assembly, and thereby enhancing the strength of connection of the two cables 40.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A cable connection device comprising:

a first shell;

a plurality of conducting terminals mounted on the first shell;

a second shell covering the first shell; and two cables mounted on the first shell and the second shell, wherein:

the first shell includes a main portion and a restriction portion mounted on the main portion;

the main portion is provided with a mounting face which is provided with a receiving recess;

the restriction portion is secured in the receiving recess and is provided with a plurality of partitions and a plurality of mounting spaces located between the plurality of partitions;

the plurality of conducting terminals extend into the plurality of mounting spaces respectively;

the second shell is provided with a plurality of press blocks;

each of the two cables includes a plurality of conducting wires;

each of the plurality of conducting wires includes a conducting core and an insulating layer coating an outside of the conducting core;

the plurality of conducting wires of each of the two cables extend to the plurality of conducting terminals, and the plurality of press blocks of the second shell extend into the plurality of mounting spaces and press the plurality of conducting wires of each of the two cables, with the plurality of conducting terminals piercing the plurality of conducting wires of the two cables simultaneously, to connect and electrically conduct the plurality of conducting wires of the two cables by the plurality of conducting terminals;

the receiving recess is arranged in an inclined manner, with an angle being defined between an extending direction of the receiving recess and that of the main portion; and each of the plurality of press blocks is arranged in an inclined manner and has an inclination equal to that of the plurality of partitions.

2. The cable connection device of claim 1, wherein each of the plurality of press blocks has a middle position provided with a breach.

3. The cable connection device of claim 1, wherein the receiving recess has two sides extending toward the main portion and forming a first opening and a second opening.

4. The cable connection device of claim 1, wherein:

the main portion of the first shell has two opposite sides each provided with a groove;

the second shell includes a cover plate and two locking plates extending from two opposite sides of the cover plate;

each of the two locking plates extends into a respective groove; and the plurality of press blocks is located at an inner face of the cover plate.

5. The cable connection device of claim 4, wherein the groove has a bottom wall provided with a rib, and each of the two locking plates has a distal end provided with a hook hooked onto the rib.

6. The cable connection device of claim 4, wherein the cover plate is provided with two opposite protruding pieces extending into the receiving recess and pressing the two cables.

7. A cable connection device comprising:

a first shell;

a plurality of conducting terminals mounted on the first shell;

a second shell covering the first shell; and two cables mounted on the first shell and the second shell, wherein:

the first shell includes a main portion and a restriction portion mounted on the main portion;

the main portion is provided with a mounting face which is provided with a receiving recess;

the restriction portion is secured in the receiving recess and is provided with a plurality of partitions and a plurality of mounting spaces located between the plurality of partitions;

the plurality of conducting terminals extend into the plurality of mounting spaces respectively;

the second shell is provided with a plurality of press blocks;

each of the two cables includes a plurality of conducting wires;

each of the plurality of conducting wires includes a conducting core and an insulating layer coating an outside of the conducting core;

the plurality of conducting wires of each of the two cables extend to the plurality of conducting terminals, and the plurality of press blocks of the second shell extend into the plurality of mounting spaces and press the plurality of conducting wires of each of the two cables, with the plurality of conducting terminals piercing the plurality of conducting wires of the two cables simultaneously, to connect and electrically conduct the plurality of conducting wires of the two cables by the plurality of conducting terminals;

the mounting face is further provided with a first channel and a second channel, with the receiving recess being arranged between the first channel and the second channel;

the first channel and the second channel are directed toward two opposite directions;

each of the first channel and the second channel has an extending direction intersecting that of the receiving recess;

the first channel has a substantially L-shaped arrangement and is formed with a first entrance and a second entrance; and the second channel has a substantially L-shaped arrangement and is formed with a third entrance and a fourth entrance.

8. The cable connection device of claim 7, wherein the receiving recess has a bottom provided with a locking slot, and the restriction portion is locked in the locking slot.

9. The cable connection device of claim 7, wherein each of the plurality of conducting terminals includes an embedding portion embedded into a bottom of the restriction portion and two projections protruding from an embedding portion and extending into each of the plurality of mounting spaces.

* * * * *